US008144917B2

(12) United States Patent
Won et al.

(10) Patent No.: US 8,144,917 B2
(45) Date of Patent: Mar. 27, 2012

(54) DYNAMIC TYPE UNIT WITH MULTIPLE MAGNETIC FIELD SYSTEM

(76) Inventors: Jang-Seok Won, Seongnam-si (KR); Hui-Su Jang, Goyang-si (KR)

( * ) Notice: Subject to any disclaimer, the term of this patent is extended or adjusted under 35 U.S.C. 154(b) by 894 days.

(21) Appl. No.: 12/159,925

(22) PCT Filed: Jul. 19, 2007

(86) PCT No.: PCT/KR2007/003502

§ 371 (c)(1),
(2), (4) Date: Jul. 2, 2008

(87) PCT Pub. No.: WO2008/010679

PCT Pub. Date: Jan. 24, 2008

(65) Prior Publication Data

US 2008/0298630 A1 Dec. 4, 2008

(30) Foreign Application Priority Data

Jul. 21, 2006 (KR) ..... 10-2006-0068283

(51) Int. Cl.
*H04R 1/00* (2006.01)

(52) U.S. Cl. ..... 381/421; 381/414; 381/400

(58) Field of Classification Search ..... 381/421, 381/414, 420, 422, 412, 400
See application file for complete search history.

(56) References Cited

U.S. PATENT DOCUMENTS 5,461,677 A * 10/1995 Raj et al. ..... 381/422

FOREIGN PATENT DOCUMENTS

| | | |
|---|---|---|
| JP | 2001-128287 | 5/2001 |
| JP | 2003-047090 | 2/2003 |
| JP | 2005-354571 | 12/2005 |

* cited by examiner

*Primary Examiner* — Charles Garber
*Assistant Examiner* — Reema Patel
(74) *Attorney, Agent, or Firm* — Lexyoume IP Group, PLLC

(57) ABSTRACT

The present invention relates to a dynamic type unit with a multiple magnetic field system, and more particularly, to a dynamic type unit including a magnet, a diaphragm and a moving coil such as a microphone or a speaker, wherein an auxiliary magnet is mounted around a main magnetic field formed by the magnet so as to form an auxiliary magnetic field to thereby correct a waveform of each individual distorted frequency generated from the microphone or the speaker, which results in realization of the best sound whose quality is closest to that of an original sound.

4 Claims, 10 Drawing Sheets

【FIG 1】
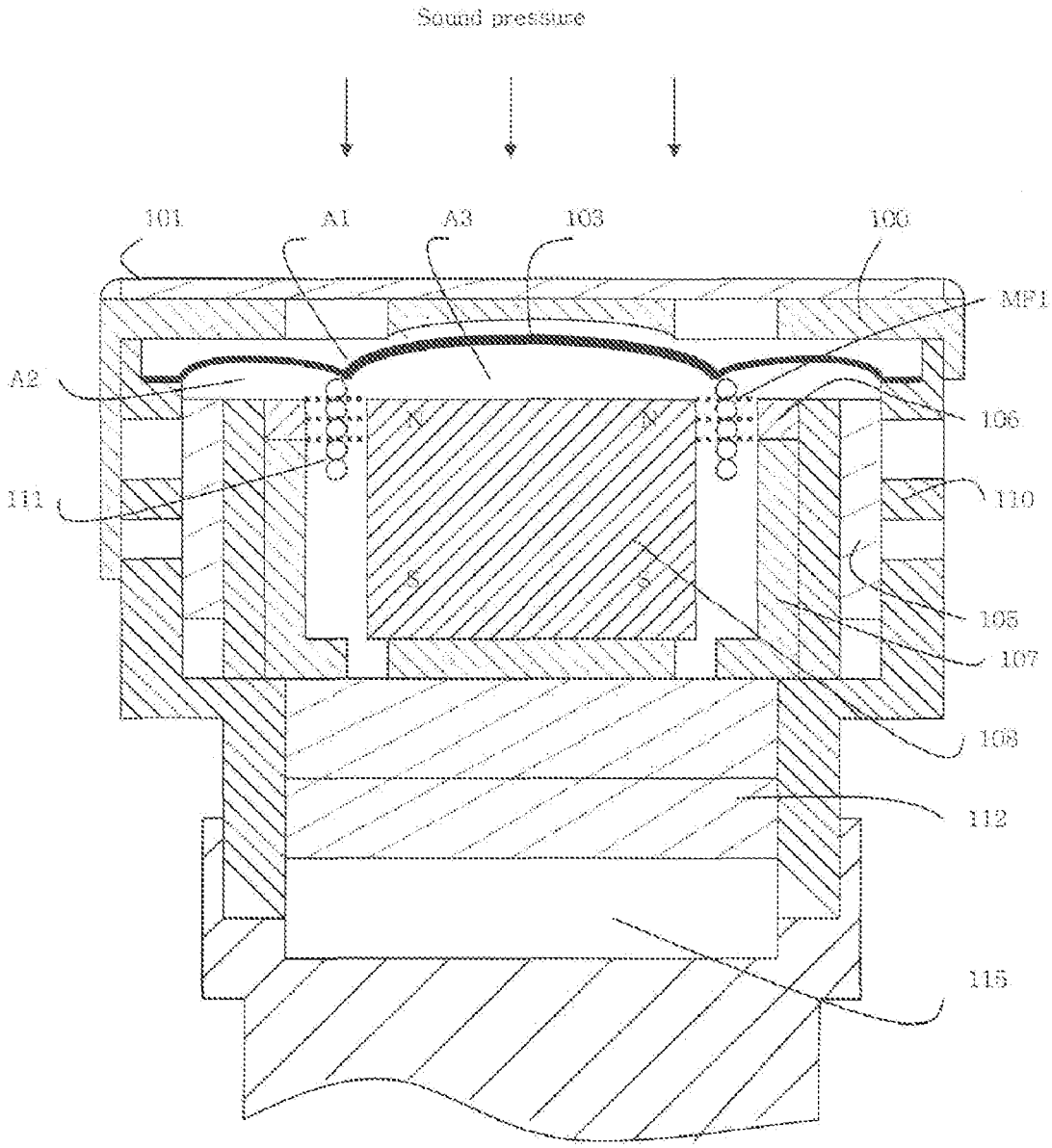
PRIOR ART

【FIG 2】
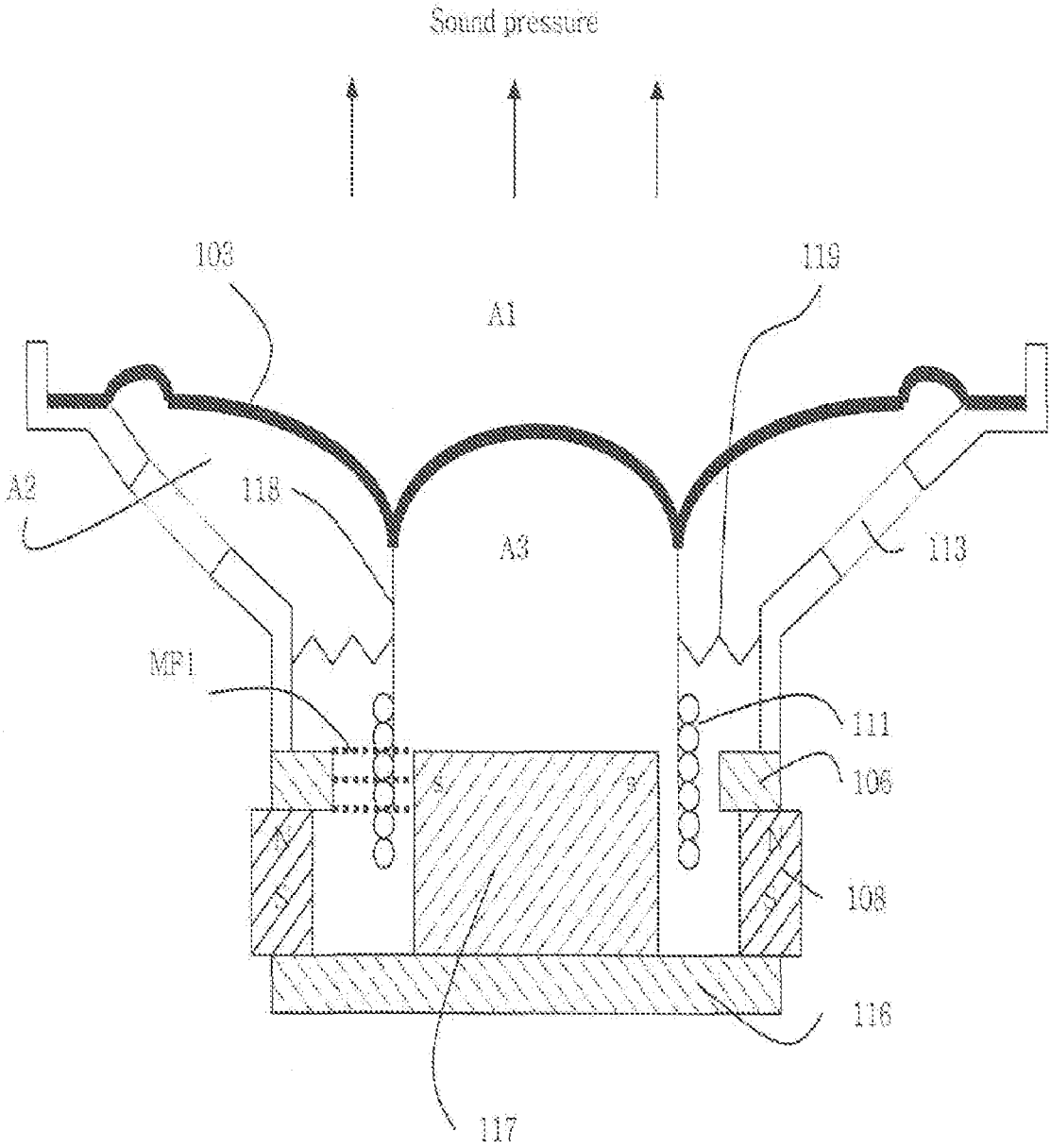
PRIOR ART

【FIG 3】
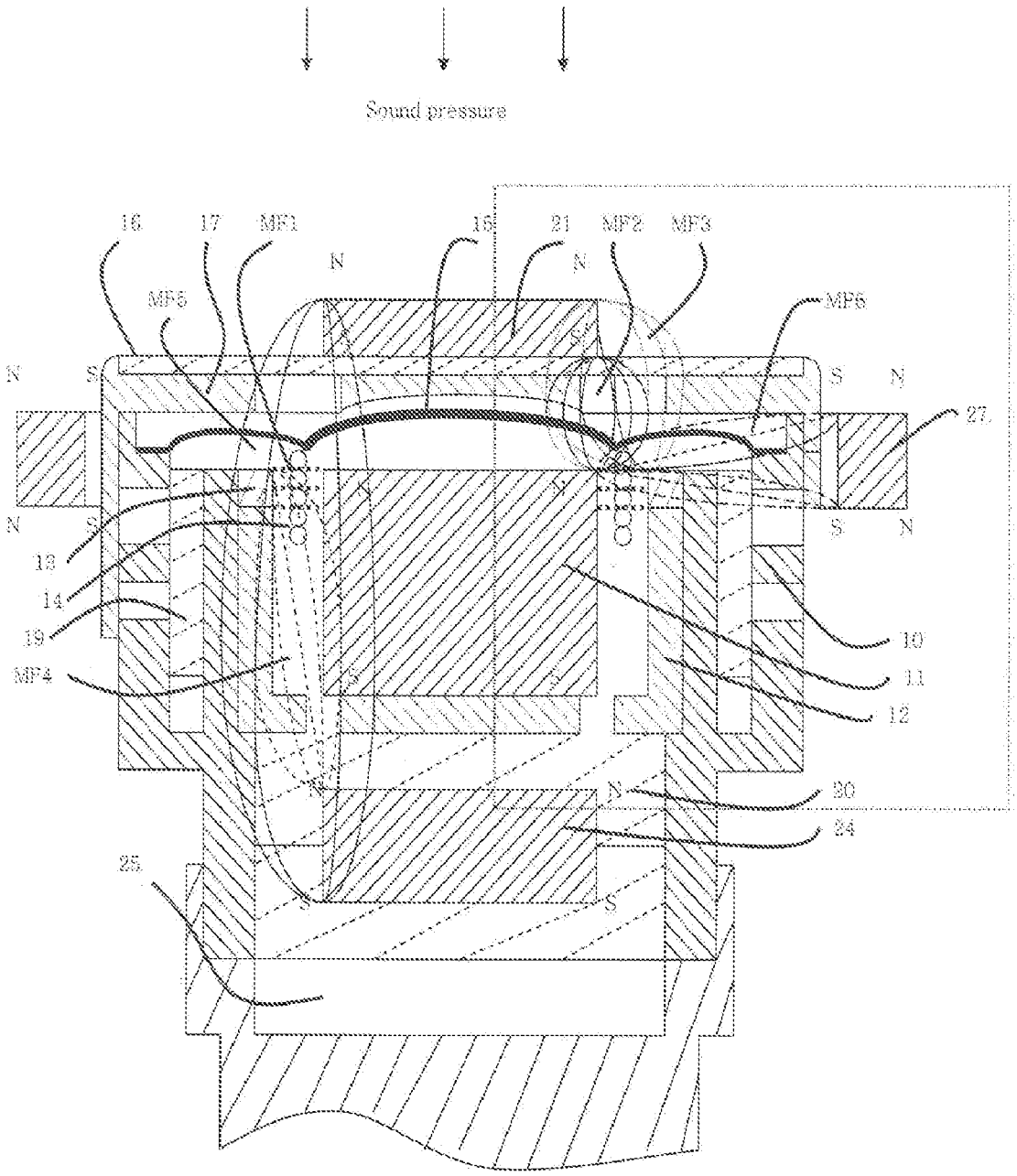

【FIG 4】
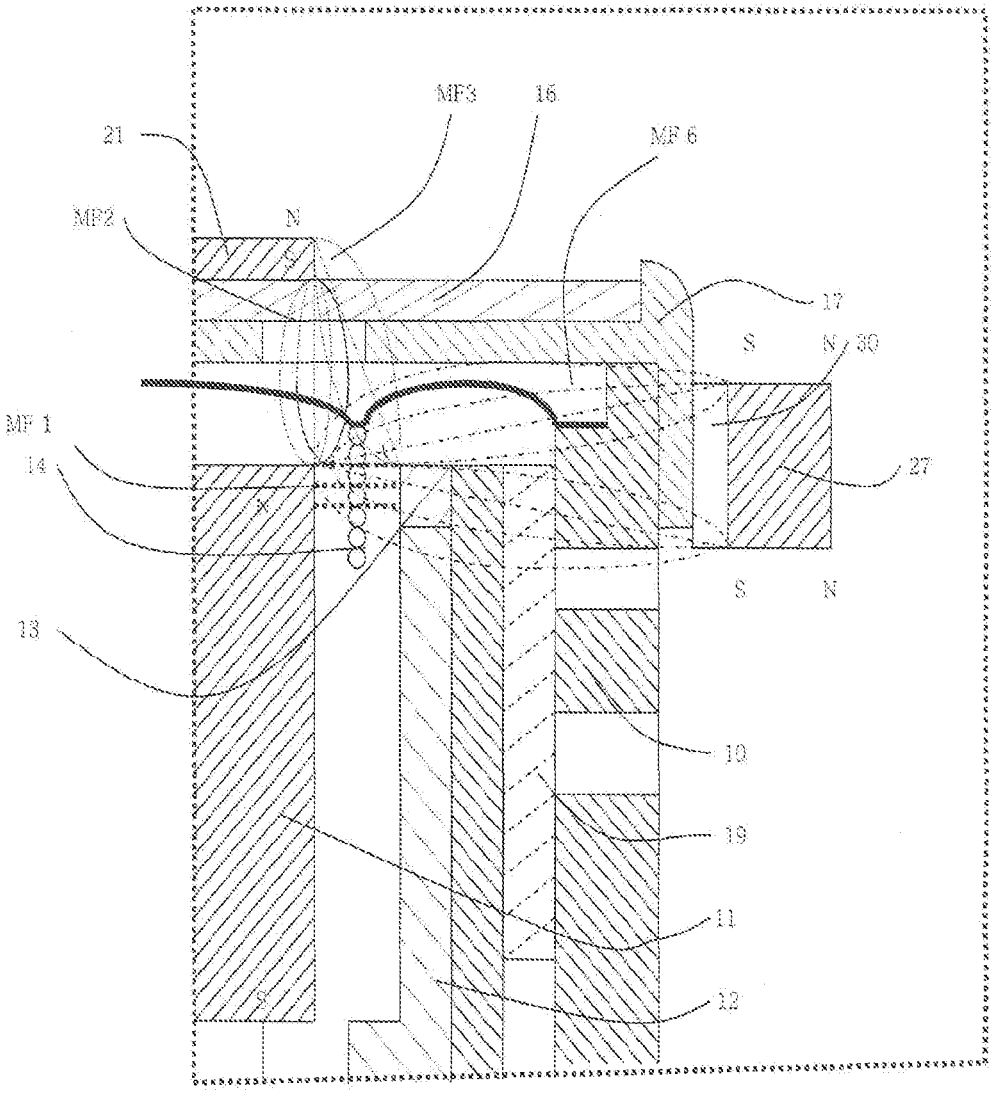

【FIG 5】
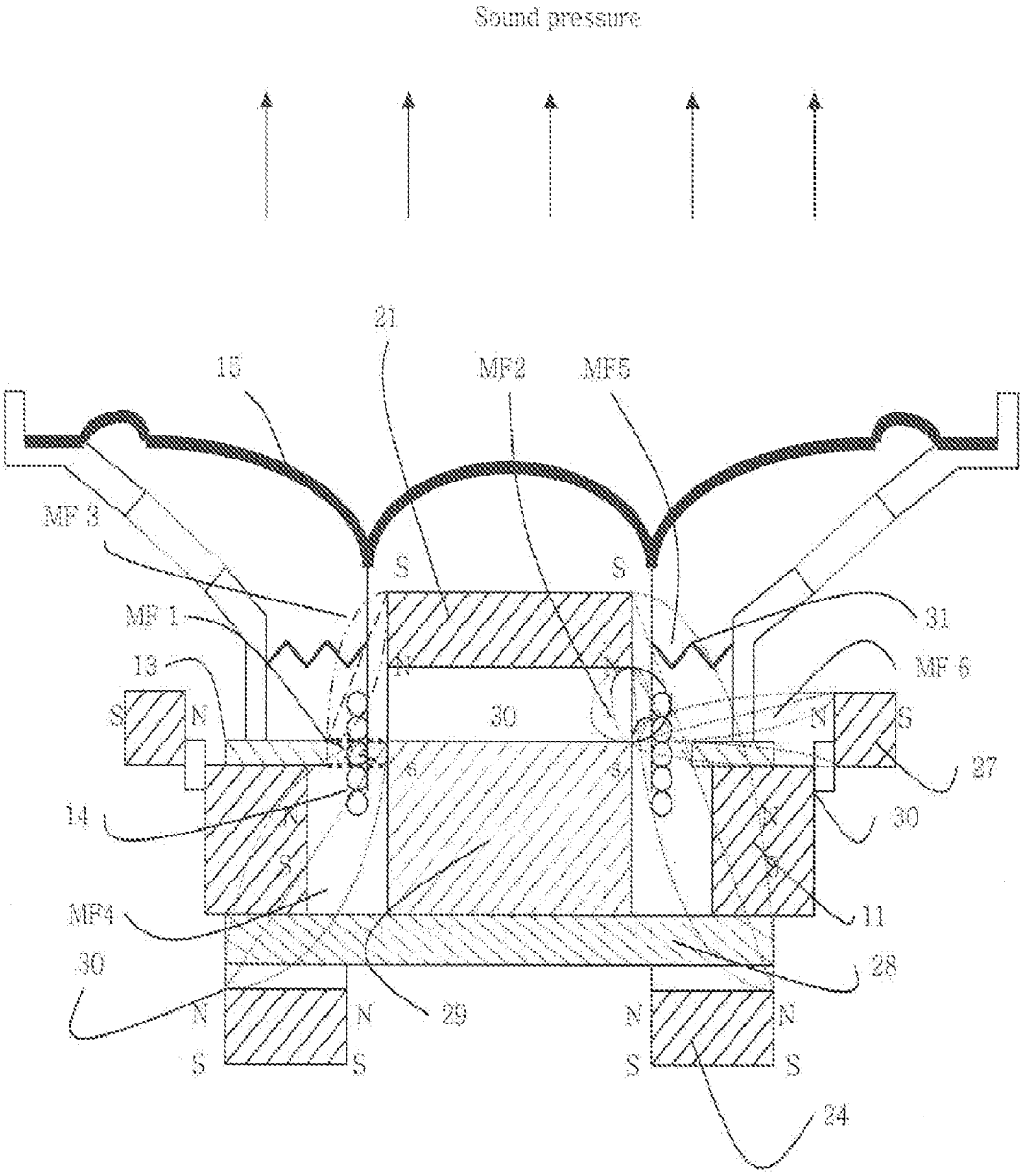

【FIG 6】
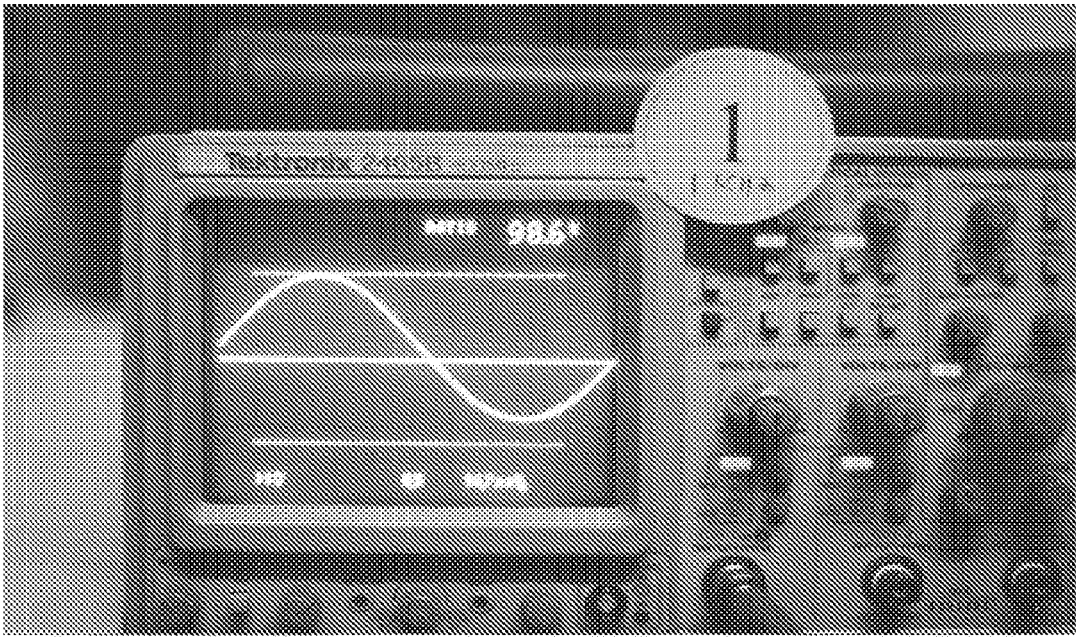
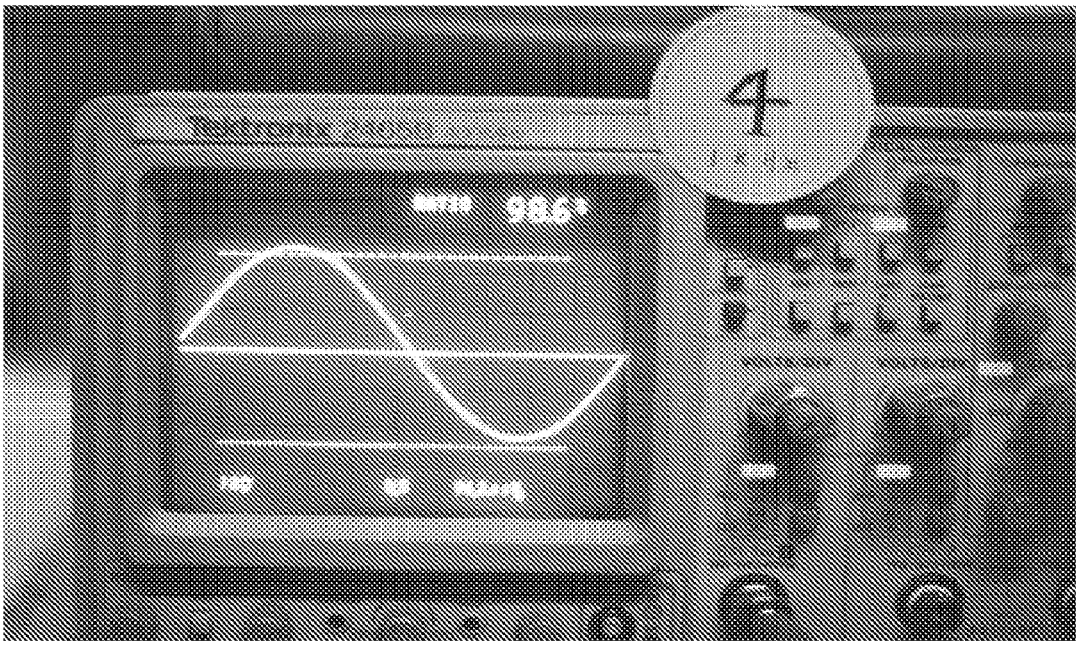

【FIG 7】
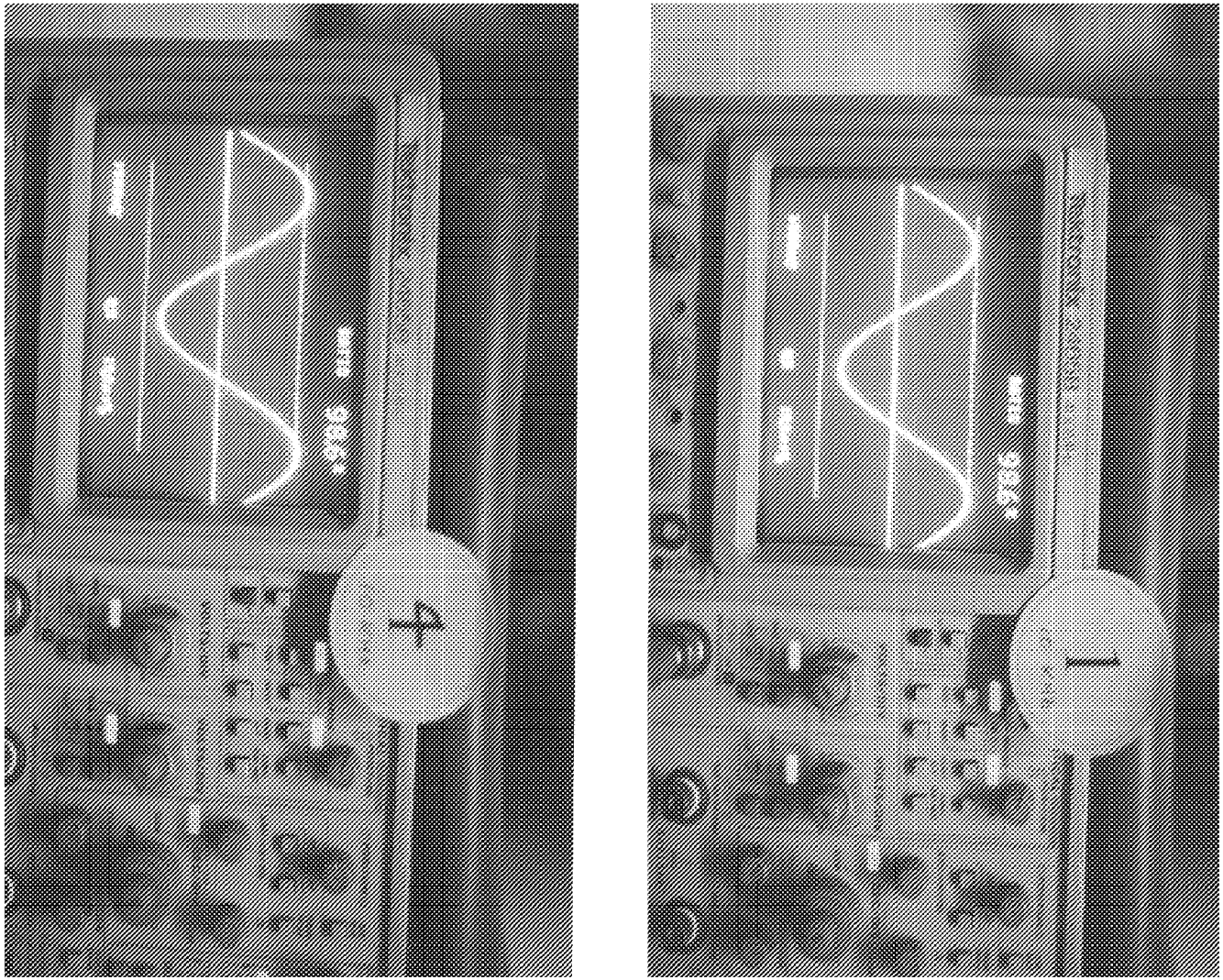

【FIG 8】
| | |
|---|---|
| Date | 200 . . . |
| Record No. | |
| Sign | |
FREQUENCY RESPONSE
Sweep Generator : SSG 113
Tracer : FCB 113
Recorder : WX 4000
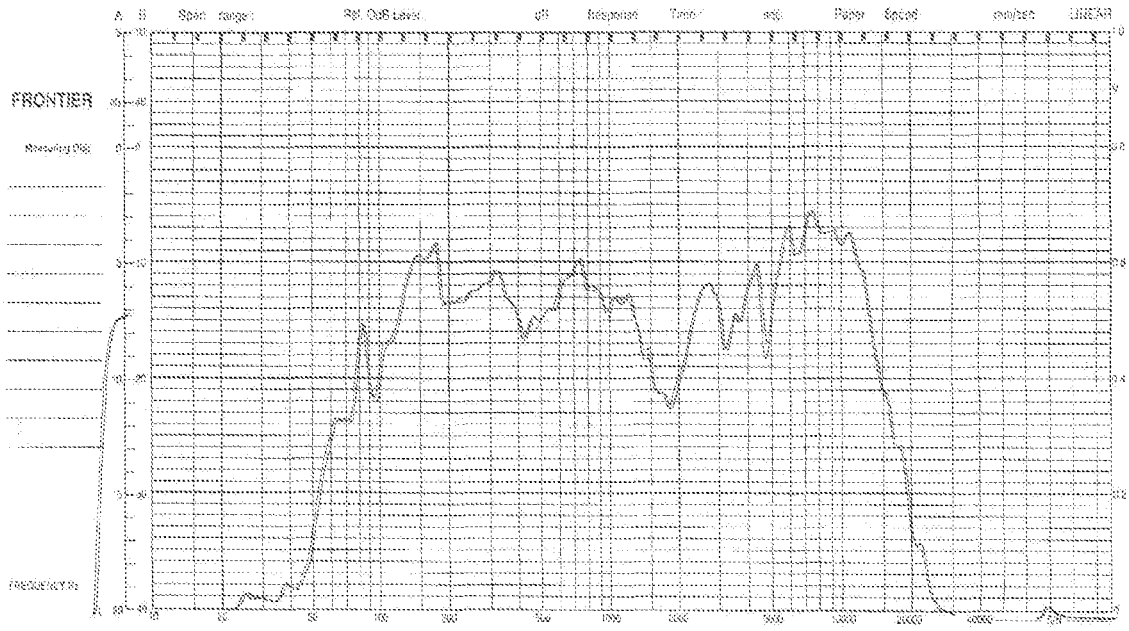
Acoustic Research FRONTIER
MANUFACTURER & EXPORTER
SHIN SUNG ELECTRONICS IND., CO.
Homepage http://www.sse-frontier.co.kr
CH RANGE/SWEEP MEOS. SUPP. FILT VERNI
X 1 ms/sec ON ON OFF 32.82
Y 0.5 V/div ON OFF OFF 38.72

【FIG 9】
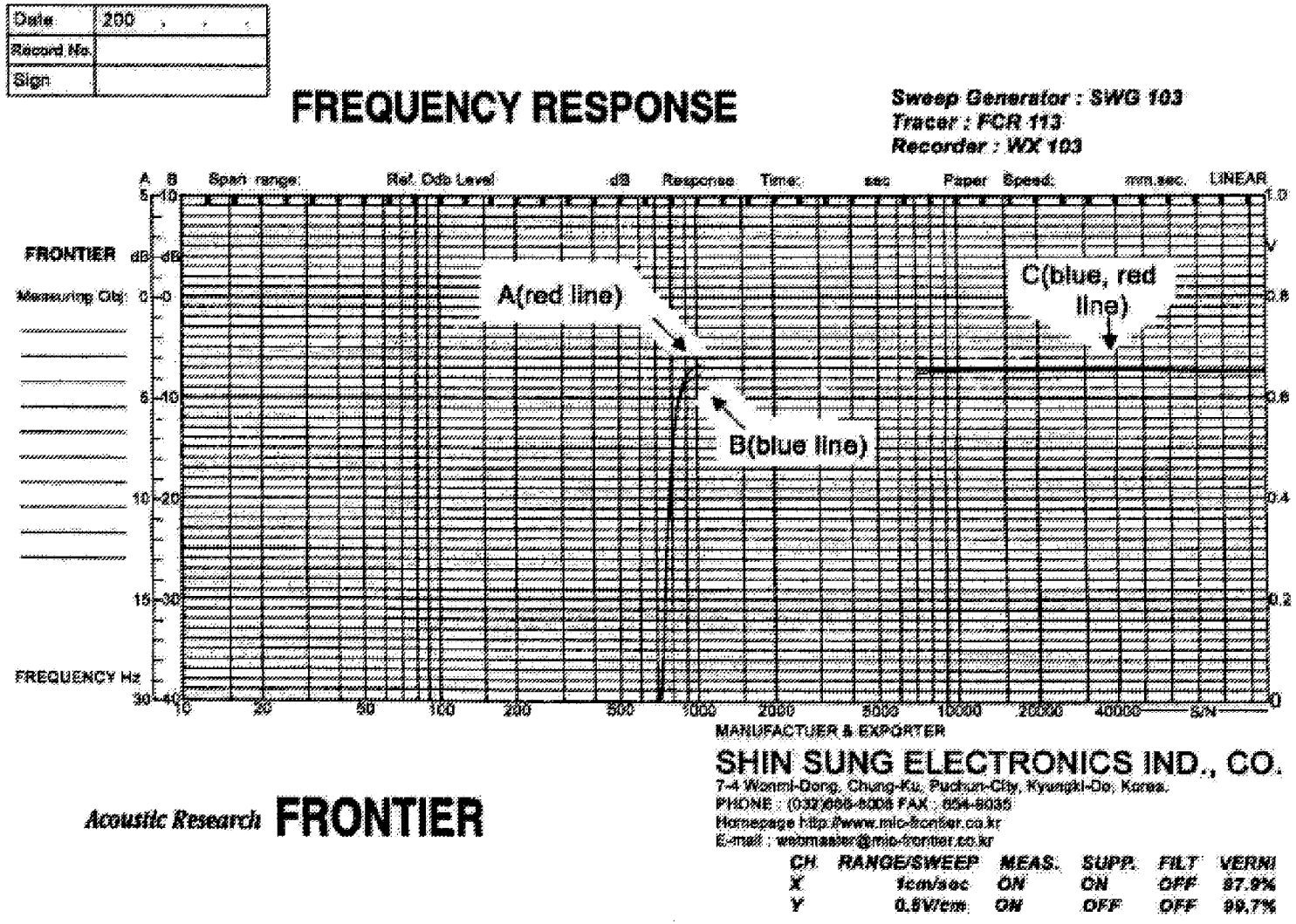

【FIG 10】
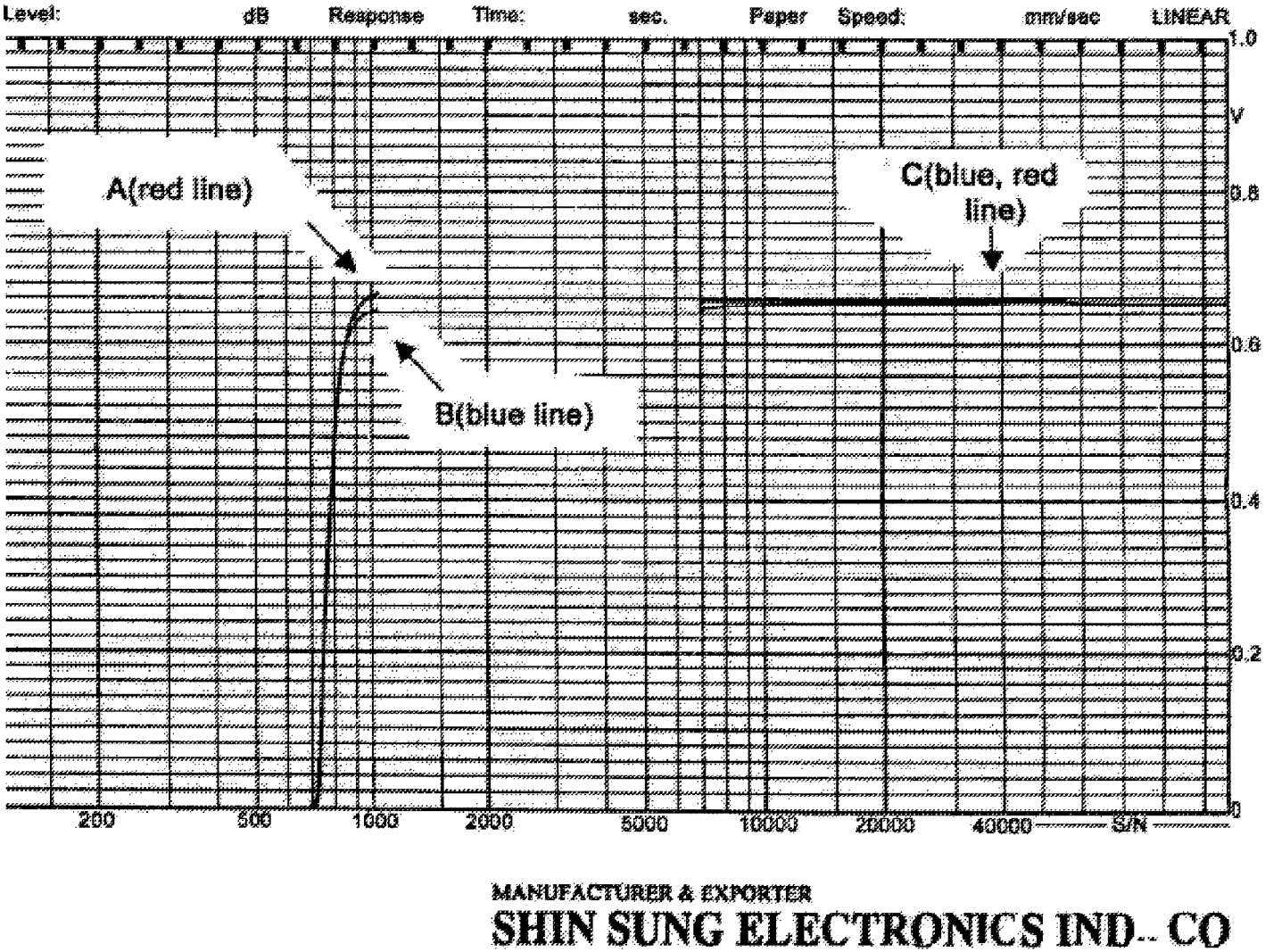

DYNAMIC TYPE UNIT WITH MULTIPLE MAGNETIC FIELD SYSTEM

TECHNICAL FIELD

The present invention relates to a dynamic type unit with a multiple magnetic field system, and more particularly, to a dynamic type unit including a magnet, a diaphragm and a moving coil such as a microphone or a speaker, wherein an auxiliary magnet is mounted around a main magnetic field formed by the magnet so as to form an auxiliary magnetic field to thereby correct a waveform of each individual distorted frequency generated from the microphone or the speaker, which results in realization of the best sound whose quality is closest to that of an original sound.

BACKGROUND ART

In general, a microphone that converts vibration energy generated by a sound pressure into electric energy or a speaker that converts electric energy into vibration energy includes a magnet constituting a magnetic circuit, and a diaphragm and a moving coil constituting a vibration system. Such a microphone or speaker is commonly called 'dynamic type unit'.

FIG. 1 is a cross-sectional view illustrating the structure of a conventional microphone according to the prior art.

As shown in FIG. 1, when a diaphragm 103 vibrates upwardly and downwardly by a sound pressure indicated by arrows, a moving coil 111 disposed at the underside of the diaphragm 103 also moves upwardly and downwardly. Then, an N magnetic polarity formed at an upper portion of a magnetized magnet 108 and an S magnetic polarity formed at a lower portion of the magnet 108 form an S magnetic polarity around a plate 106 via a yoke 107 and a magnetic field MF1 is formed between the magnet 108 and the plate 106. Like this, the moving coil 111 moves upwardly and downwardly within the magnetic field MF1 to cause an electromagnetic induction to occur according to Faraday's law of induction. That is, an induced electromotive force is generated at both ends of the moving coil 111. In this case, as the waveform of the induced electromotive force becomes nearer a sinusoidal wave, a sound whose quality is closer to that of the original sound can be obtained.

A tone color reproduced by the microphone as shown in FIG. 1 is determined depending on the adjustment of the amount of air in a space A1 by means of a first filter 101, the adjustment of the amount of air to be discharged in a space A2 by means of a second filter 102, the adjustment of the amount of air to be discharged in a space A3 by means of a third filter 103, and the formation of a vortex of residual air within a reflective tank. In FIG. 1, non-explained reference numeral 100 denotes an upper cover and non-explained reference numeral 110 denotes a housing, respectively.

Also, FIG. 2 is a cross-sectional view illustrating the structure of a conventional speaker according to the prior art. As shown in FIG. 2, when an electrical signal is applied to a moving coil 111 between a plate 106 and a magnet 106/a pole 117, the moving coil 111 moves upwardly and downwardly to cause a diaphragm 103 to vibrate so as to discharge compress or discharge air in spaces A1, A2 and A3 to thereby reproduce an original sound.

It is important that a tone color of the speaker as shown in FIG. 2 is determined depending on the proper control of vibration of the diaphragm 103 by means of a spider 119, and the adjustment of the amount of air in the spaces A2 and A3 through lateral air holes 113. In FIG. 2, non-explained reference numeral 116 denotes a pole plate and non-explained reference numeral 118 denotes a bobbin, respectively.

In such a dynamic type unit, the induced electromotive force generated from the moving coil 111, i.e., sound quantity is determined depending on a gauss magnetic flux density of the magnet 108, a spacing between an N pole of the magnet 108 and an S pole of the plate 106, the number of windings of the moving coils 111, the thickness of a winding conductor, a change in resistance values, et. In addition, a frequency response is mostly determined depending on the thickness and material of the diaphragm 103, the shape of patterns engraved on the diaphragm 103 to facilitate the flow of sound pressure, etc.

DISCLOSURE OF INVENTION

Technical Problem

As described above, in the conventional dynamic type unit, a basic magnetic field MF1 is formed between the plate and the magnet. Thus, if the movement range of the moving coil goes beyond a portion where the magnetic field MF1 is most densely concentrated, the induced electromotive force is not generated smoothly and the moving coil itself produces an intrinsic vibration, thus adversely affecting the reproduction of a normal sinusoidal wave. Further, the conventional microphone and speaker exhibit universal characteristics in the frequency response and sensitivity, but show sound quality and sound clearness relatively deteriorated as compared to those of the original sound.

Meanwhile, Korean Patent Laid-Open Publication No. 2000-40796 (laid opened on Jul. 5, 2000) discloses a speaker unit including a dual magnet in which an auxiliary magnet is mounted at an inner periphery of a magnet. Similarly, an auxiliary magnet is also attached on an underside of a pole plate. Such a conventional speaker unit is constructed such that the auxiliary magnet is direct contact with a pole and the pole plate as components constituting a basic magnetic circuit so as to additionally supply a magnetic force of the auxiliary magnet to the basic magnetic circuit, thereby improving a gain of the sensitivity and realizing compactness and lightness. However, the conventional speaker unit does not suggest An effect of correcting a waveform of each individual distorted frequency generated from the speaker to thereby realize the best sound whose quality is closest to that of an original sound.

In addition, Japanese Patent Laid-Open Publication No. Hei17-354571 (laid opened on Dec. 22, 2005) is directed to a dynamic type microphone unit constructed such that an auxiliary magnet having the same polarity as that of an upper side of a main magnet is oppositely disposed at an upper portion of a basic magnetic circuit to form an anti-magnetic field. Such a microphone unit is aimed at reducing magnetic leakage to improve sensitivity. However, actually, in a structure in which the same polarities confront each other, the magnetic force of the main magnet is decreased due to repulsion of the anti-magnetic field, which makes it impossible to expect a sensitivity improvement effect.

Accordingly, the present invention has been made in an effort to solve the above-mentioned problems occurring in the prior art, and it is an object of the present invention to provide a dynamic type unit with a multiple magnetic field system, which includes a main magnet constituting a basic magnetic circuit, and a diaphragm and a moving coil constituting a vibration system in the basic magnetic circuit, wherein a waveform of each individual frequency generated by vibration of the diaphragm is corrected into a distortion-free accurate sinusoidal waveform to thereby realize the best sound whose quality is closest to that of an original sound without a change in a basic design value.

Technical Solution

To accomplish the above object, according to the present invention, there is provided a dynamic type unit with a multiple magnetic field system, which comprises: a main magnet adapted to constitute a basic magnetic circuit; a diaphragm and a moving coil which are adapted to constitute a vibration system in the basic magnetic circuit; and at least one auxiliary magnet mounted at least one of an upper portion, a lower portion and a lateral portion of the main magnet in such a fashion as to be spaced apart from the main magnet, wherein the total value of a magnetic flux density of the auxiliary magnet is 25-100% of a magnetic flux density value of the main magnet.

In the present invention, the magnetic flux density values of the upper and lateral auxiliary magnets are 25% of the magnetic flux density value of the main magnet, respectively, and the magnetic flux density value of the lower auxiliary magnet is 50% of the magnetic flux density value of the main magnet.

Also, in the present invention, a spacing between the main magnet and the auxiliary magnet is within a range between 0.1 mm and a distance less than a thickness of the main magnet.

According to most preferred embodiment of the present invention, there is provided a dynamic type unit with a multiple magnetic field system, which comprises: a main magnet adapted to constitute a basic magnetic circuit; a diaphragm and a moving coil which are adapted to constitute a vibration system in the basic magnetic circuit; and an auxiliary magnet mounted at an upper portion, a lower portion and a lateral portion of the main magnet in such a fashion as to be spaced apart from the main magnet, wherein the magnetic flux density values of the upper and lateral auxiliary magnets are 25% of the magnetic flux density value of the main magnet, respectively, and the magnetic flux density value of the lower auxiliary magnet is 50% of the magnetic flux density value of the main magnet.

BRIEF DESCRIPTION OF THE DRAWINGS

FIG. 1 is a cross-sectional view illustrating the structure of a conventional microphone according to the prior art;

FIG. 2 is a cross-sectional view illustrating the structure of a conventional speaker according to the prior art;

FIG. 3 is a cross-sectional view illustrating the structure of a microphone according to a preferred embodiment of the present invention;

FIG. 4 is a magnified cross-sectional view illustrating a state in which multiple magnetic field system is formed in FIG. 3;

FIG. 5 is a cross-sectional view illustrating the structure of a speaker according to another preferred embodiment of the present invention;

FIG. 6 is photographs showing sinusoidal waveforms of an individual frequency of 1 KHz obtained from an inventive microphone 1 and a conventional microphone 4, respectively;

FIG. 7 is photographs showing sinusoidal waveforms of an individual frequency of 10 KHz obtained from an inventive speaker 1 and a conventional speaker 4, respectively;

FIG. 8 is a graph showing a comparison of an entire frequency response between the inventive microphone and the conventional microphone;

FIG. 9 is a graph showing a comparison of a sensitivity response output upon the application of a trigger signal having a frequency of 1 KHz between the inventive microphone and the conventional microphone; and FIG. 10 is a magnified graph showing important portions of FIG. 9.

BEST MODE FOR CARRYING OUT THE INVENTION

Reference will now be made in detail to the preferred embodiment of the present invention with reference to the attached drawings.

The present invention is directed to a dynamic type unit which includes a basic magnetic circuit and a vibration system such as a microphone or a speaker. The basic magnetic circuit is composed of a main magnet, a plate and a yoke in case of a microphone, and is composed of a main magnet, a pole and a pole plate in case of a speaker. Also, the vibration system is typically composed of a diaphragm and a moving coil.

The present invention is characterized in that at least one auxiliary magnet is mounted at least one of an upper portion, a lower portion and a lateral portion of the main magnet constituting the basic magnetic circuit in such a fashion as to be spaced apart from the main magnet. In this case, the auxiliary magnet may be mounted at least one or two of the upper portion, the lower portion and the lateral portion of the main magnet. Specially, the lateral auxiliary magnet may be mounted at both sides, i.e., left and right sides of the main magnet, and may be mounted at left and right sides, and front and rear sides of the main magnet in four directions so as to encompass the main magnet. Preferably, an upper auxiliary magnet, a lower auxiliary magnet and a lateral auxiliary magnet are all mounted around the main magnet. In the present invention, in case where only one auxiliary magnet is mounted, it is most effective that the lower auxiliary magnet is mounted at the main magnet.

In the present invention, preferably, the total value of a magnetic flux density of the auxiliary magnet is 25-100% of a magnetic flux density value of the main magnet. In this case, the magnetic flux density values of the upper and lateral auxiliary magnets are 25% of the magnetic flux density value of the main magnet, respectively, and the magnetic flux density value of the lower auxiliary magnet is 50% of the magnetic flux density value of the main magnet. Thus, in case where the upper, lower and lateral auxiliary magnets are all mounted around the main magnet, the total value of a magnetic flux density of the auxiliary magnets is identical to the magnetic flux density value of the main magnet.

If the ratio of the magnetic flux density values of the upper, lower and lateral auxiliary magnets is deviated from 25%:50%:25%, a change in a magnetic density occurs at a portion where the magnetic field is densely concentrated at the time of formation of a multiple magnetic field system, which causes a problem in equilibrium and stability in formation of a magnetic field by the main magnet and the auxiliary magnets to thereby reduce the effect of a multiple magnetic field system. In the present invention, magnets made of different kinds of materials may be used as respective auxiliary magnets. But, even in this case, the ratio of the magnetic flux density values of the auxiliary magnets is preferably set in the above ratio.

In addition, a spacing between the main magnet and the auxiliary magnet is preferably within a range between 0.1 mm and a distance less than a thickness of the main magnet. In the present invention, a separation guide is installed between the main magnet and the auxiliary magnet, and the spacing between the main magnet and the auxiliary magnet may be set within a range less than 0.1 mm depending on the performance of the separation guide. That is, 0.1 mm, i.e., a lower limit of the spacing between the main magnet and the auxiliary magnet symbolically indicates a minimum distance at which the main magnet and the auxiliary magnet are not in close contact with each other, and the numerical value itself of the lower limit does not technically imply a critical meaning.

In the meantime, when the spacing between the main magnet and the auxiliary magnet is greater than the thickness of the main magnet, the magnetic density of a portion of a cross magnetic field decreases to thereby reduce the effect of a multiple magnetic field system. This can be seen well from a magnetic tape showing the flux density of a magnetic field. In the present invention, even when the spacing between the main magnet and the auxiliary magnet is within the distance obtained by adding the thicknesses of the main magnet, the yoke and the plate constituting the basic magnetic circuit, the desired effect appears somewhat. Also, preferably, the diameter of the auxiliary magnet is equal to or smaller than that of the main magnet.

The dynamic type unit according to the present invention can be implemented with any one of a microphone, a speaker, a headphone, an earphone and a buzzer.

FIG. 3 is a cross-sectional view illustrating the structure of a microphone having a multiple magnetic field system according to a preferred embodiment of the present invention. A main magnet 11, a yoke 12 and a plate 13 constitute a basic magnetic circuit, a moving coil 14 and a diaphragm 15 constitute a vibration system. A moving coil 14 moves upwardly and downwardly in a basic magnetic field MF1 formed between an S pole of the plate 13 and an N pole of the main magnet 11 so as to vibrate a diaphragm 15 to thereby generate an electromotive force. The electromotive force is reproduced by an amplifying means which is not shown. Non-explained reference numeral 10 denotes a housing, non-explained reference numeral 16 denotes a first filter, non-explained reference numeral 17 denotes a cover, non-explained reference numeral 19 denotes a second filter and non-explained reference numeral 20 denotes a third filter.

The present invention is characterized in that an upper auxiliary magnet 21 is mounted at the top central portion of the first filter 16. The upper auxiliary magnet 21 has a magnetic flux density value corresponding to 25% of the magnetic flux density value of the main magnet 11. A spacing between the upper auxiliary magnet 21 and the main magnet 11 is preferably set in such a fashion that the bottom surface of the upper auxiliary magnet 21 are spaced apart from the top surface of the main magnet 11 by a distance less than a thickness of the main magnet 11. But, the spacing between the upper auxiliary magnet 21 and the main magnet 11 may be within the distance obtained by adding the thicknesses of the main magnet 11, the yoke 12 and the plate 13 constituting the basic magnetic circuit.

Also, a lateral auxiliary magnet 27 is mounted at the outer wall of the cover 17. The lateral auxiliary magnet 27 has a magnetic flux density value corresponding to 25% of the magnetic flux density value of the main magnet 11. A spacing between the lateral auxiliary magnet 27 and the main magnet 11 is preferably set in such a fashion that the inner wall surface of the lateral auxiliary magnet 27 are spaced apart from the outer wall surface of the main magnet 11 by a distance less than a thickness of the main magnet 11. But, the spacing between the lateral auxiliary magnet 27 and the main magnet 11 may be within the distance obtained by adding the thicknesses of the main magnet 11, the yoke 12 and the plate 13.

In addition, a lower auxiliary magnet 24 is mounted inside the third filter 20 serving to adjust the amount of air in a reflective tank 25 in such a fashion as to be spaced apart from the yoke 12 by a predetermined distance. The lower auxiliary magnet 24 has a magnetic flux density value corresponding to 50% of the magnetic flux density value of the main magnet 11. A spacing between the lower auxiliary magnet 24 and the main magnet 11 is preferably set in such a fashion that the bottom surface of the yoke 12 are spaced apart from the top surface of the lower magnet 24 by a distance less than a thickness of the main magnet 11. But, the spacing between the lower magnet 24 and the main magnet 11 may be within the distance obtained by adding the thicknesses of the main magnet 11, the yoke 12 and the plate 13 constituting the basic magnetic circuit.

In the present invention, it is most preferably that the spacing between the main magnet 11 and each of the auxiliary magnets 21, 24 and 27 is within a range between 0.1 mm and a distance less than a thickness of the main magnet, and the total value of a magnetic flux densities of the auxiliary magnets 21, 24 and 27 is identical to a magnetic flux density value of the main magnet.

According to the present invention, in a microphone unit mounted with the auxiliary magnets 21, 24 and 27 as shown in FIGS. 3 and 4, a magnetic field MF2 is formed between an S pole of the upper auxiliary magnet 21 and an N pole of the main magnet 11, and a magnetic field MF3 is formed between an N pole of the upper auxiliary magnet 21 and an S pole of the plate 13. Also, a magnetic field MF4 is formed between an N pole of the lower auxiliary magnet 24 and an S pole of an edge of the plate 13 via the yoke 12, a magnetic field MF5 is formed between an N pole of the upper auxiliary magnet 21 and an S pole of the lower magnet 24, and a magnetic field MF6 formed between an S pole of the lateral auxiliary magnet 27 and an N pole of the main magnet 11, respectively. Beside these, although having a less influence than that of the multiple magnetic fields MF2 to MF6, a plurality of multiple magnetic fields which are not shown are formed to encompass the entire unit.

In this manner, the basic magnetic field MF1 is formed between the main magnet 11 and the plate 13, and a multiple magnetic field (MF2 to MF6) block is formed by the auxiliary magnets 21, 24 and 27. In this state, when the moving coil 14 vibrates vertically along with the diaphragm 15 by the pressure of a sound source, the multiple magnetic fields MF2 to MF6 formed additionally correct the generation of an induced electromotive force as an intrinsic function of the moving coil 14, so that a waveform of each individual frequency is not distorted and a sinusoidal wave of a complete waveform is caused to be formed to thereby realize the best sound whose quality is closest to that of the original sound. Moreover, the multiple magnetic fields MF2 to MF6 encompass the entire unit to prevent demagnetization occurring naturally and shield an external anti-magnetic field to maintain the best sound whose quality is closest to that of the original sound.

In the present invention, despite installation of the auxiliary magnets 21, 24 and 27, there is no change in basic design values used conventionally such as a magnetic flux density value of the main magnet 11, a resistance value of the moving coil 14, the number of windings of the moving coil 14, the amount of air adjusted by the first, second and third filters 16, 19 and 20, density values of the respective filters 16, 19 and 20, the amount of air for a vortex of the reflective tank 25, etc.

Meanwhile, FIG. 5 is a cross-sectional view illustrating the structure of a speaker having a multiple magnetic field system according to another preferred embodiment of the present invention. In case of the speaker, a main magnet 11, a pole plate 28 and a pole 29 constitute a basic magnetic circuit, and a moving coil 14 and a diaphragm 15 constitute a vibration system. The present invention is characterized in that after it is assumed that an imaginary horizontal line runs from the top surface of the plate 13 to the top surface of the pole 29, a separation guide 30 for space separation is attached to the top surface of the pole 29, and an upper auxiliary magnet 21 is mounted on the top surface of the separation guide 30 in such a fashion that left and right halves thereof are symmetrical to each other with respect to a horizontal central line of the pole 29. Also, after it is assumed that an imaginary horizontal line runs on the bottom surface of the pole plate 28, a separation guide 30 for space separation is attached to the bottom surface of the pole plate 28, and a lower auxiliary magnet 24 is mounted on the bottom surface of the separation guide 30 in such a fashion as to be symmetrical to each other with respect to the horizontal central line of the pole 29. In addition, after it is assumed that an imaginary horizontal line runs on the top surface of the pole 29, a separation guide 30 for space separation is attached to the outer wall surface of the main magnet 11, and a lateral auxiliary magnet 27 is mounted on the outer surface of the separation guide 30 in such a fashion as to be symmetrical to each other with respect to the horizontal central line of the pole 29. Thus, the separation guide 30 is disposed between the main magnet 11 and the lateral auxiliary magnet 27. The ratio of the magnetic flux density values of the auxiliary magnets 21, 24 and 27 and the spacing between the main magnet 11 and each of auxiliary magnets 21, 24 and 27 are identical to those in case of the microphone of FIG. 3. Non-explained reference numeral 31 denotes a spider.

As shown in FIG. 5, the speaker having the multiple magnetic fields also has a basic magnetic field MF1 and a multiple magnetic field (MF2 to MF6) block formed therein.

Now, the effect of the dynamic type unit according to the present invention will be described hereinafter.

FIG. 6 is photographs showing the output characteristics of sinusoidal waveforms of an individual frequency of 1 KHz measured from an inventive microphone 1 and a conventional microphone 4, respectively, and FIG. 7 is photographs showing the output characteristics of sinusoidal waveforms of an individual frequency of 10 KHz measured from an inventive speaker 1 and a conventional speaker 4, respectively. A device used to measure the output characteristics includes an audio sweep generator (SWG 103, Japan kokuyo), a speaker (EV 2502, USA Electro voice), an oscillator (Tektronix 2465B, USA), a probe (Strack IP 005, Japan), etc.

As shown in FIGS. 6 and 7, the dynamic type unit 1 of the present invention shows that an accurate and smooth waveform is formed at a curved portion around a peak point of a sinusoidal wave at the upper end portion marked on a screen of an oscillator. However, the conventional unit 4 shows that the curved portions of valleys and crests of a sinusoidal wave are distorted so as to be boosted higher than a limit line, so that they are protruded more upwardly as compared to those of the sinusoidal wave and a vibration occurs greatly at a waveform portion of a peak point. Thus, it can be seen that the conventional unit 4 does not implement a complete original sound and reproduce a distorted sound.

FIG. 8 is a graph showing a comparison of an entire frequency response between the inventive microphone and the conventional microphone. A device used to measure the output characteristics of the microphones includes an audio sweep generator (SWG 103, Japan kokuyo), an audio tracer (FCR 113, Japan kokuyo), a recorder (WX 400, Japan leader), a speaker (EV 2502, USA Electrovoice), etc. The measurement result of the frequency response was obtained such that an output power of 1 W was amplified by an amplifier with it spaced apart from a speaker within an anechoic room composed of the above measurement devices, and then an audio signal was swept at an interval of 10 seconds.

As a result of the experiment, it can be seen from FIG. 8 that the inventive microphone and the conventional microphone do not show any change in sensitivity and frequency response. That is, in the basic magnetic circuit constituted by the main magnet, the yoke and the plate, a value of an electromotive force generated upon the actuation of the moving coil is not changed despite additional formation of the auxiliary magnetic fields by the auxiliary magnets according to the present invention.

Meanwhile, FIG. 9 is a graph showing a comparison of a sensitivity response of crests and valleys of a frequency waveform output upon the application of a trigger signal having a frequency of 1 KHz between the inventive microphone and the conventional microphone. In FIG. 9, a red line A is a curve of a sensitivity response generated when a trigger signal having a frequency of 1 KHz is applied to the conventional microphone for 0.1 second, and a blue line B is a curve of a sensitivity response generated when a trigger signal having a frequency of 1 KHz is applied to the inventive microphone for 0.1 second. And, blue and red lines C at the right side are curves of a sensitivity response generated when a continuous signal having a frequency of 1 KHz is applied to the both microphones.

FIG. 10 is a magnified graph showing important portions of FIG. 9.

In FIGS. 9 and 10, a device used to measure the output characteristics of each microphone includes an audio sweep generator (SWG 103, Japan Kokuyo), an audio tracer (Audio Tracer, FCR 113, Japan Kokuyo), a recorder (WX 4000, Japan Leader), a speaker (EV 2502, USA, Electro voice), etc.

Measurement Method

The inventive microphone unit and the conventional microphone unit were mounted spaced apart from a speaker by a distance of 1 m within an anechoic room. The speaker outputs a signal obtained by amplifying a frequency of 1 Khz output to a frequency of 1 W. Then, a trigger signal was applied to the both microphone units for 0.1 second, respectively, and then a frequency sensitivity response and a difference in crests and valleys of a sinusoidal waveform output from each of the two microphones were recorded. Thereafter, after one second, the trigger signal was continuously applied to the both microphone units and a continuous frequency sensitivity response at 1 Khz for each microphone unit was recorded. The same test was repeatedly performed two times to enhance of accuracy of the test.

Measurement Result

As a result of the test, it can be seen that in case of the conventional microphone unit, as shown in the red line A of FIG. 10, the output of the conventional microphone unit responding to a trigger signal received by the conventional microphone unit upon the application of the trigger signal to the conventional microphone unit is relatively more distorted so as to be upwardly boosted as compared to the output of the conventional microphone unit responding to a continuous signal received by the conventional microphone unit upon the application of the continuous signal to the conventional microphone unit, i.e., a level of the line C at the right side.

That is, when the conventional microphone unit receives the trigger signal, the moving coil attached to the diaphragm moves vertically within a single magnetic field formed by the main magnet and the plate so as to generate an electromotive force. At this time, there occurs a situation where the movement range of the moving coil goes beyond a densely concentrated effective range of a basic magnetic field generating the maximum effective electromotive force. If this situation occurs, the moving coil does not sufficiently produce the induced electromotive force to thereby degrade an electromotive force generating efficiency. On the other hand, the influence of intrinsic vibration of the moving coil and the diaphragm increases. For this reason, distortion occurs diffusely at the portions of the crests and valleys of the sinusoidal wave.

On the contrary, the inventive microphone unit responses to an absolute value of an applied trigger signal at the time of application of the trigger signal thereto, and derives only an output of the absolute value. Thus, it can be seen from the graph of FIG. 10 that the blue line B is maintained at the same level as that of the line C at the right side, and there is no change in sensitivity response.

That is, the inventive microphone unit allows the multiple magnetic fields to be formed by the auxiliary magnets besides the basic magnetic circuit. Therefore, although the movement rage of the moving coil goes beyond the optimum range of the basic magnetic field, the inventive microphone unit enables deterioration of the electromotive force generating efficiency or distortion caused by its intrinsic vibration of the diaphragm or the moving coil to be corrected to thereby implement a complete sinusoidal wave.

INDUSTRIAL APPLICABILITY

As described above, the present invention has an advantageous effect in that it is applied to a dynamic type unit such as a speaker or a microphone so that a waveform of each individual frequency generated by vibration of the diaphragm is corrected into a distortion-free accurate sinusoidal waveform to minimize howling and hum to thereby realize the best sound whose quality is closest to that of an original sound without a change in a basic design value.

The dynamic type unit having a multiple magnetic field system according to present invention can also be applied to a headphone, an earphone, a buzzer, etc., besides the speaker or the microphone.

While the invention has been in detail described in connection with what is presently considered to be preferred practical exemplary embodiments, it is to be understood that the invention is not limited to the disclosed embodiments. But, it is to be noted that this design modification should be interpreted as falling within the scope of the present invention as long as a new effect does not appear which is not expected in the present invention due to the design modification.

The invention claimed is:

1. A dynamic type unit with a multiple magnetic field system, which comprises:

a main magnet adapted to constitute a basic magnetic circuit;

a diaphragm and a moving coil which are adapted to constitute a vibration system in the basic magnetic circuit; and at least one auxiliary magnet mounted at least one of an upper portion, a lower portion and a lateral portion of the main magnet in such a fashion as to be spaced apart from the main magnet, wherein the total value of a magnetic flux density of the auxiliary magnet is 25-100% of a magnetic flux density value of the main magnet, and wherein the magnetic flux density values of the upper and lateral auxiliary magnets are 25% of the magnetic flux density value of the main magnet, respectively, and the magnetic flux density value of the lower auxiliary magnet is 50% of the magnetic flux density value of the main magnet.

2. The system according to claim 1, wherein a spacing between the main magnet and the auxiliary magnet is within a range between 0.1 mm and a distance less than a thickness of the main magnet.

3. A dynamic type unit with a multiple magnetic field system, which comprises:

a main magnet adapted to constitute a basic magnetic circuit;

a diaphragm and a moving coil which are adapted to constitute a vibration system in the basic magnetic circuit; and an auxiliary magnet mounted at an upper portion, a lower portion and a lateral portion of the main magnet in such a fashion as to be spaced apart from the main magnet, wherein the magnetic flux density values of the upper and lateral auxiliary magnets are 25% of the magnetic flux density value of the main magnet, respectively, and the magnetic flux density value of the lower auxiliary magnet is 50% of the magnetic flux density value of the main magnet.

4. The system according to claim 1, wherein a spacing between the main magnet and the auxiliary magnet is within a range between 0.1 mm and a distance less than a thickness of the main magnet.

* * * * *